US007455632B2

(12) United States Patent
Block et al.

(10) Patent No.: US 7,455,632 B2
(45) Date of Patent: Nov. 25, 2008

(54) EXERCISE DEVICE

(75) Inventors: Steve Block, Carmel, IN (US); Jesse Allen Cartwright, Uniontown, OH (US)

(73) Assignee: Spri Products, Inc., Libertyville, IL (US)

( * ) Notice: Subject to any disclaimer, the term of this patent is extended or adjusted under 35 U.S.C. 154(b) by 765 days.

(21) Appl. No.: 10/958,905

(22) Filed: Oct. 5, 2004

(65) Prior Publication Data

US 2006/0073954 A1 Apr. 6, 2006

(51) Int. Cl.
*A63B 21/00* (2006.01)

(52) U.S. Cl. ..... 482/126; 482/121; 482/907

(58) Field of Classification Search ..... 482/121, 482/125, 907, 909
See application file for complete search history.

(56) References Cited

U.S. PATENT DOCUMENTS

| | | | | | |
|---|---|---|---|---|---|
| 200,708 | A | * | 1/1878 | George | 177/173 |
| 739,035 | A | * | 9/1903 | Triner | 177/173 |
| 2,299,980 | A | * | 10/1942 | Hansen | 177/173 |
| 2,930,614 | A | | 3/1960 | McIntosh | |
| 4,441,707 | A | | 4/1984 | Bosch | |
| 4,570,921 | A | * | 2/1986 | Arnold | 482/125 |
| 4,645,197 | A | * | 2/1987 | McFee | 482/31 |
| 4,733,862 | A | | 3/1988 | Miller | |
| 4,779,867 | A | | 10/1988 | Hinds | |
| 5,062,642 | A | | 11/1991 | Berry et al. | |
| 5,131,650 | A | | 7/1992 | Hall | |
| 5,319,162 | A | * | 6/1994 | Ness | 177/231 |
| 5,800,322 | A | | 9/1998 | Block | |
| 5,820,533 | A | * | 10/1998 | Goldman | 482/124 |
| 5,913,756 | A | * | 6/1999 | Glaser | 482/128 |
| 6,110,081 | A | * | 8/2000 | Barrett | 482/121 |

OTHER PUBLICATIONS

Photocopy of Product Packaging Insert Illustrating Product.

* cited by examiner

*Primary Examiner*—Jerome Donnelly
(74) *Attorney, Agent, or Firm*—Barnes & Thornburg LLP

(57) ABSTRACT

An exercise device for use in connection with various types of exercise and activities, including, for example, Pilates, yoga, core conditioning, stability, stretching, and physical therapy. The exercise device includes an indicator for quantifying resistance force applied by the resistance tube during stretching of the tube. Repeated use of the exercise device can be used to identify strength gains.

21 Claims, 3 Drawing Sheets

EXERCISE DEVICE

BACKGROUND AND SUMMARY

The present disclosure relates to an exercise device and method of using an exercise device to identify strength gains.

Resistance exercise devices are known. An example of a resistance exercise product including a stretchable elongated tube is disclosed, for example, in U.S. Pat. No. 5,800,322, which is incorporated herein by reference.

The present disclosure relates to an exercise device that includes a stretchable elongated tube, indicia for measuring resistance force applied by the elongated tube during stretching of the elongated tube, and an indicator used to quantify the resistance force being applied. The exercise device can be used in connection with various types of exercise, including, for example, Pilates, yoga, core conditioning, stability, and stretching. The exercise device also may be used to gauge incremental strength gains during such exercise or during rehabilitation or physical therapy.

Additional features of the present disclosure will become apparent to those skilled in the art upon consideration of the following detailed description of illustrative embodiments of the disclosure.

BRIEF DESCRIPTION OF THE DRAWINGS

The detailed description particularly refers to the accompanying figures in which.

DETAILED DESCRIPTION OF THE ILLUSTRATED EMBODIMENTS

Figure 1:
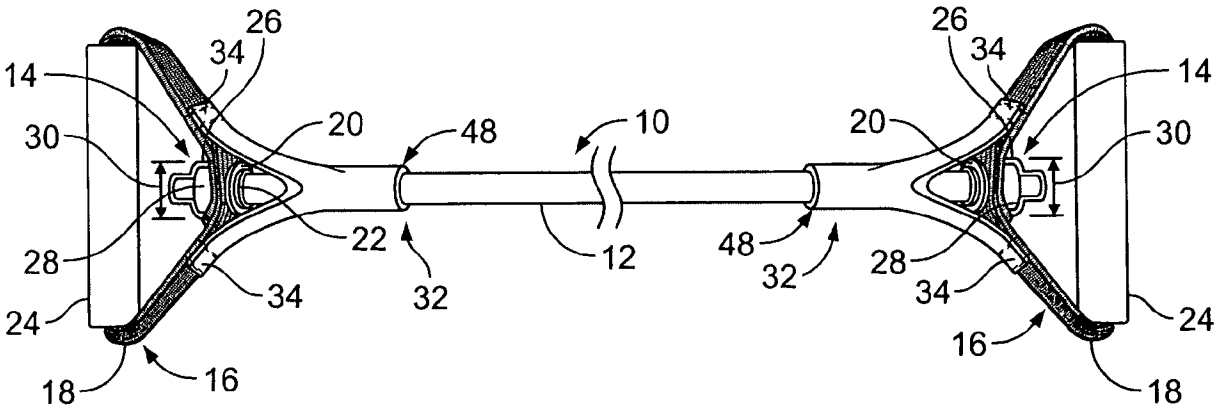
FIG. 1 is a perspective view of an exercise device in accordance with an embodiment of the present disclosure.

While the present disclosure may be susceptible to embodiment in different forms, there is shown in the drawings, and herein will be described in detail, an embodiment with the understanding that the present description is to be considered an exemplification of the principles of the disclosure and is not intended to limit the disclosure to the details of construction and the arrangements of components set forth in the following description or illustrated in the drawings.

FIGS. 1-4 illustrate an exercise device 10 in accordance with an embodiment of the present disclosure. The illustrated exercise device 10 comprises an elongated resistance tube 12 having a pair of ends 14 and a pair of handles 16. The resistance tube 12 may have any suitable construction, configuration and dimensions and may be sized for different purposes. Resistance tube 12 may, for example, be constructed of any rubber or any other suitable stretchable material, and may have any suitable dimensions.

The handles 16 also may have any suitable construction, configuration and dimensions and may be secured to resistance tube 12 in any suitable manner and at any suitable location. In the illustrated embodiment, for example, each handle 16 is associated with a respective end 14 of the resistance tube 12. Each handle 16 comprises a fabric strip 18 forming a loop and defining a hole 20 receiving the resistance tube 12, a metal grommet 22 disposed about the hole, and a tubular hand grip 24 constructed of PVC or the other like disposed about the strip 18. A handle sleeve 26 may be disposed about each end 14 of the resistance tube 12. A ridge 28 or the like may be disposed within the resistance tube 12 adjacent each of its two ends 14. The ridge 28 has a diameter 30 that is greater than the diameter of hole 20. The ridge 28 may be any protrusion that prevents handle 16 from disengaging the elongated tube 12. FIGS. 1-4 show a plug form of the ridge 28 which is received snugly within a channel defined by the resistance tube 12 adjacent the respective open end of the resistance tube and is configured to expand the channel and portions of the resistance tube 12 and handle sleeve 26 disposed about the plug. The handles 14 may instead comprise any other type of strip 18 or other structure secured to the resistance tube 12 in any suitable manner. The strip 18 or other structure may be constructed of any suitable material and have any suitable configuration in accordance with other embodiments. Similarly, each of the grommet 22, the hand grip 24, the handle sleeve 26, and the ridge 28 may have any other suitable construction or configuration or may be omitted in accordance with other embodiments. U.S. Pat. No. 5,800,322, which is incorporated herein by reference, provides examples of handles 16 and of methods of securing the handles to resistance tubes.

The illustrated exercise device 10 also includes adjacent each end an indicator 32 disposed on the elongated tube 12 shown in the form of a sleeve. The illustrated indicator 32 runs generally parallel to the elongated tube 12 and covers a portion thereof. The indicator 32 may be attached to the fabric strip 18 by one or more flanges 34. In a two-flange embodiment shown in FIGS. 1-4, for example, flanges 34 extend away from the elongated tube 12 to run adjacent to corresponding portions of fabric strip 18 and may be attached to such portions by stitching or any other suitable attachment method or structure. The indicator 32 may be of any suitable length and may be constructed of any suitable flexible or non-flexible material. The indicator 32 may have any other suitable construction and configuration and may be associated with the elongated tube 12 in any other suitable manner in accordance with other embodiments.

Figure 2:
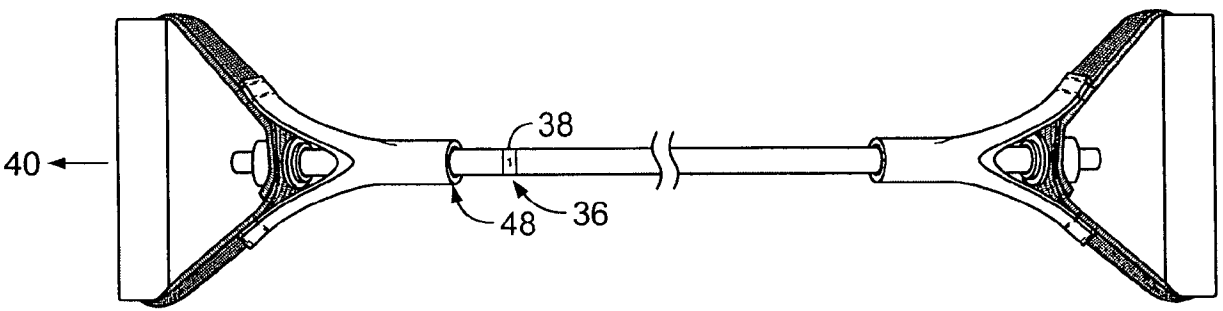
FIG. 2 is a perspective view of the exercise device of FIG. 1 being stretched to reveal a designation of indicia.

Exercise device 10 also includes indicia 36 disposed on or otherwise associated with each end of the elongated tube 12 for measuring resistance force applied by the elongated tube 12 during stretching of the elongated tube 12. Indicia 36 may take the form of one or more numbers, letters, markings, symbols, or other designations. In FIG. 2, a designation 38 of indicia 36 is shown in this embodiment as the number "1". Designation 38 of indicia 36 is revealed when the tube 12 is stretched an appropriate magnitude. (References to right and left in this disclosure are used for illustrative purposes only to correspond to the FIGS. as shown.) Exercise device 10 can be used in a horizontal, vertical, angled, or multi-directional orientation.

The exercise device 10 may include two indicators 32 and indicia 38, each indicator and each indicia associated with a respective end of the elongated tube 12, as shown, for example, in the embodiments illustrated in FIGS. 1-4 and 5. Alternatively, the exercise device 10 may instead include a single indicator 32 and indicia 38 associated with one of the ends of the elongated tube 12. In accordance with other embodiments, the exercise device 10 may include one or more indicator and indicia disposed elsewhere along the length of the elongated tube 12.

Figure 3:
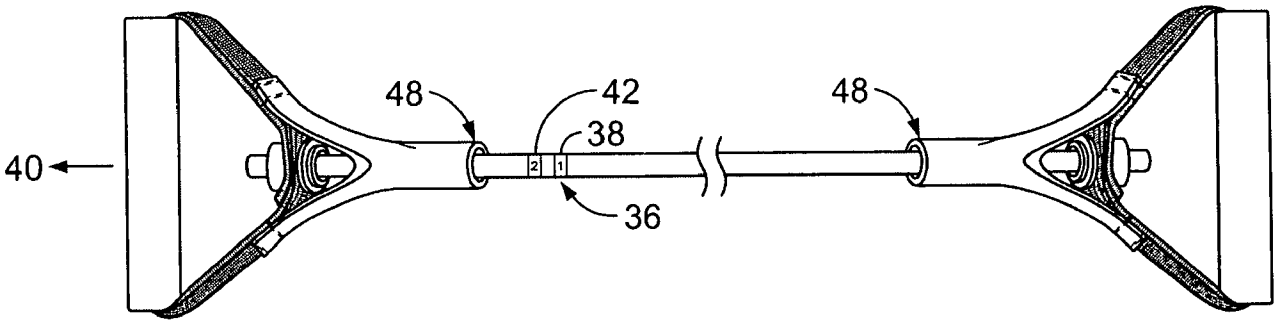
FIG. 3 is a perspective view of the exercise device of FIG. 2 being stretched further to reveal additional designations of the indicia.
Figure 4:
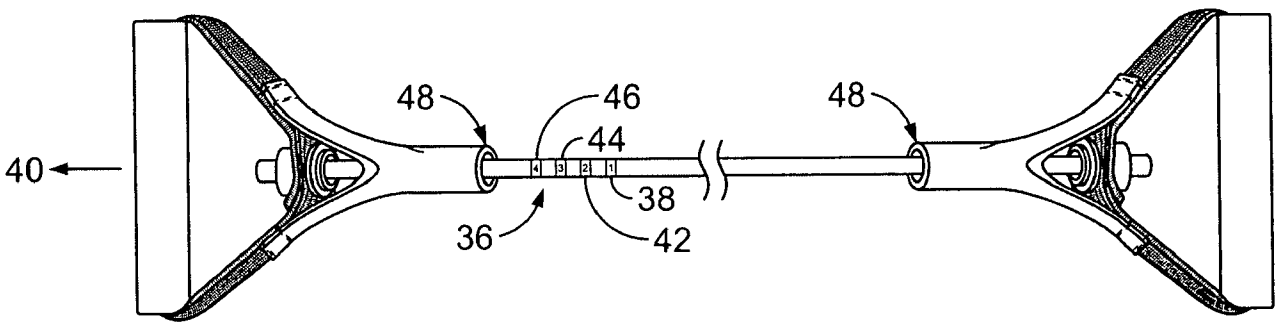
FIG. 4 is a perspective view of the exercise device of FIG. 3 being stretched further to reveal additional designations of the indicia.

Illustrated designation 38 corresponds to a first or lowest referenced resistance force level. As shown in FIG. 3, applying a greater force to further stretch the elongated tube 12 reveals a second designation 42 shown as the number "2" corresponding to a second resistance force level. Any number of designations may be positioned along elongated tube 12 to correspond to additional resistance force levels. For example, FIG. 4 shows indicia 36 comprised of four designations 38, 42, 44, 46 shown as "1", "2", "3", and "4" corresponding to four increasing resistance force levels. Using these designations, the lowest number (and resistance force level) would be positioned farthest from the respective end, with each increasing number and resistance force level being positioned progressively closer to the respective end. The designations may identify specific magnitudes of force or instead may reflect arbitrary or unidentified magnitudes of force.

A resistance force level is identified or otherwise referenced when indicator 32 aligns with indicia 36, or, for embodiments with one or more designations comprising the indicia 36, when the indicator 32 aligns with one of the designations. The illustrated indicator 32 aligns with the designation when an end 48 of the indicator moves relative to elongated tube 12 causing such indicia or other indicia to be revealed. The indicator 32 may take any form suitable for aligning with the indicia 36 to quantify a resistance force level in accordance with other embodiments. Aligning may mean revealing, pointing to, obstructing, or in any other way conveying that a designation of indicia 36 has been indicated.

Figure 5:
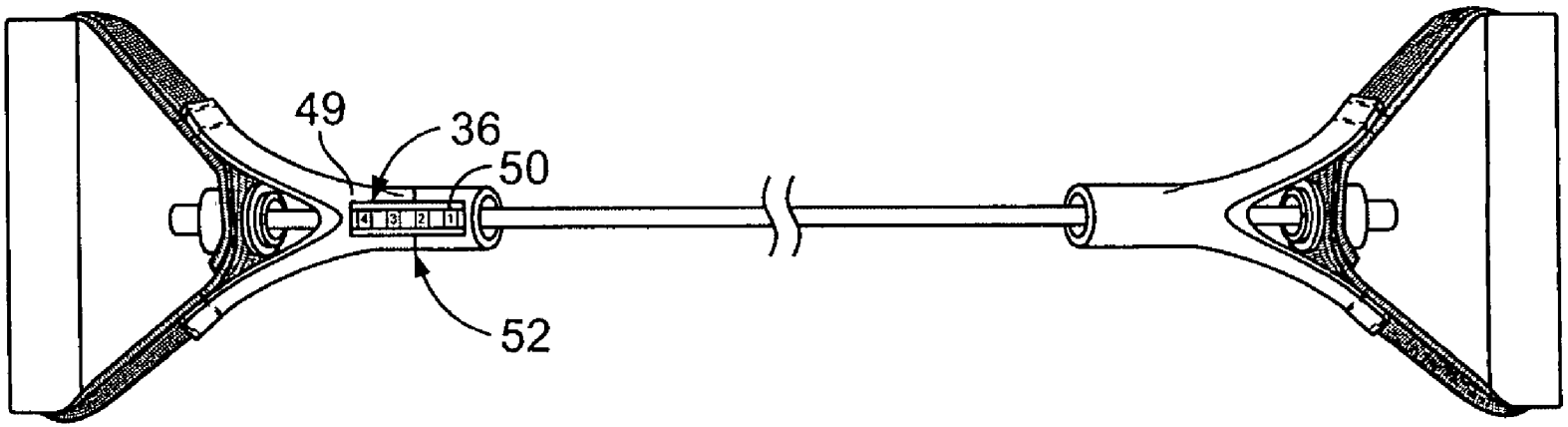
FIG. 5 is a perspective view of the exercise device in accordance with another embodiment of the present disclosure.

FIG. 5 illustrates the exercise device 10 in accordance with an alternative embodiment wherein the indicator comprises a sleeve 49 that defines a window 50 for identifying the resistance force level. The window 50 may be a cutout region of the sleeve 49, or be formed of a transparent material such as a clear plastic. The illustrated indicator 52 may include a line, stripe, arrow, or any other marking that can align with indicia 36 during stretching of the elongated tube 12. The indicator may have any other suitable construction and configuration in accordance with other embodiments.

The exercise device 10 can be used in connection with various types of exercises and activities, including, for example, Pilates, yoga, core conditioning, stability, stretching, rehabilitation, and physical therapy. The exercise device 10 can be used in any suitable manner. Depending on the exercise, either or both handles of the pair of handles 16 can be engaged with feet or any other part of the legs, hands or any other part of the arms, or with any structure. Additionally, one of the handles 16 may be omitted. There are countless exercises that can be performed with the exercise device 10.

In use, for the embodiment shown in FIGS. 1-4, both indicia 36 are covered by respective indicators 32 shown in the form of a sleeve. The elongated tube 12 is then stretched. During stretching, the location of at least one of the indicators relative to its respective indicia 36 can be viewed to quantify the resistance force being applied by the elongated tube 12 during such stretching. This quantifying is accomplished by observing one or more designations of at least one of the indicia 36 being revealed and attributing increasing resistance force levels to each designation. (Whether one or both of the indicators 32 and respective indicia 36 of the illustrated exercise device 10 can be used to quantify force may depend upon the type of exercise being performed.) A user is thus able to gauge a strength gain by noticing the user can initially only cause a lower designation to be revealed, for example, a "1", and then during subsequent exercise noticing a higher designation has been revealed, for example, a "3". This can be useful, for example, to gauge the progress of physical therapy and rehabilitation, to quantify gains during training programs, or for other purposes.

While the concepts of the present disclosure have been illustrated and described in detail in the drawings and foregoing description, such an illustration and description is to be considered as exemplary and not restrictive in character, it being understood that only the illustrative embodiment has been shown and described and that all changes and modifications that come within the spirit of the disclosure are desired to be protected by the following claims.

The claimed invention is:

1. An exercise device comprising:

a stretchable elongated tube;

indicia for measuring resistance force applied by the elongated tube during stretching of the elongated tube;

an indicator configured to align with the indicia to quantify the resistance force being applied by the elongated tube during stretching of the elongated tube; and a handle, the handle associated with an end of the elongated tube;

wherein the indicator is associated with the handle and wherein the handle comprises a loop and the indicator is attached to the loop and disposed about the elongated tube, the indicator extending proximal from the handle.

2. The exercise device of claim 1 wherein the indicator comprises a sleeve disposed about the elongated tube.

3. The exercise device of claim 2 further comprising at least one flange securing the sleeve to the loop.

4. The exercise device of claim 2 further comprising a pair of flanges securing the sleeve to the loop.

5. The exercise device of claim 4 wherein the flanges are stitched to the loop.

6. The exercise device of claim 2 wherein the loop defines a hole receiving the elongated tube.

7. The exercise device of claim 6 wherein the handle is engaged with the elongated tube and further comprising a ridge positioned proximal of the end of the elongated tube, the ridge having a diameter greater than a diameter of the hole, the ridge configured to prevent the handle from disengaging from the elongated tube.

8. The exercise device of claim 6 wherein the ridge comprises a plug.

9. An exercise device comprising:

a stretchable elongated tube;

a handle associated with an end of the elongated tube;

a sleeve attached to the handle and disposed about the elongated tube; and indicia disposed on the elongated tube for measuring resistance force applied by the elongated tube during stretching of the elongated tube, the sleeve configured to initially cover the indicia and then to expose the indicia to quantify the resistance force being applied by the elongated tube during stretching of the elongated tube.

10. The exercise device of claim 9 wherein the indicia is a plurality of designations, each designation corresponding to a different resistance force level.

11. The exercise device of claim 10 wherein each of the designations is a number, the lowest number being positioned farthest from the end and each other designation in the plurality of designations being positioned closer to the end.

12. The exercise device of claim 11, wherein the numbers are arranged in order of increasing resistance levels.

13. An exercise device comprising:

a stretchable elongated tube having a pair of ends;

a pair of handles, each handle associated with a respective end;

a pair of indicia disposed on the elongated tube for measuring resistance force applied by the elongated tube during stretching of the elongated tube; and a pair of indicators disposed about the elongated tube, each indicator associated with a respective indicia and configured to align with the respective indicia to quantify the resistance force being applied by the elongated tube during stretching of the elongated tube, each indicator of the pair of indicators is attached to a respective handle.

14. The exercise device of claim 13 wherein each indicator of the pair of indicators comprises a sleeve.

15. The exercise device of claim 14 wherein each handle in the pair of handles comprises a loop.

16. The exercise device of claim 15 wherein each loop defines a hole receiving an end of the elongated tube.

17. The exercise device of claim 16 wherein the handles are engaged with the elongated tube and each end of the elongated tube further comprises a ridge having a diameter greater than a diameter of a respective hole, the ridge adapted to prevent the respective handle from disengaging from the elongated tube.

18. The exercise device of claim 10, wherein each of the designations is a number.

19. The exercise device of claim 10, wherein each of the designations is a color.

20. An exercise device comprising:

a stretchable elongated tube having a pair of ends;

a pair of handles, each handle associated with a respective end of the elongated tube;

a sleeve attached to one of the handles and disposed about the elongated tube; and indicia disposed on the elongated tube for measuring resistance force applied by the elongated tube during stretching of the elongated tube, the sleeve configured to initially cover the indicia and then to expose the indicia to quantify the resistance force being applied by the elongated tube during stretching of the elongated tube.

21. The exercise device of claim 20 wherein the indicia is a plurality of designations, each designation corresponding to a different resistance force level.

* * * * *